United States Patent [19]

Gendron et al.

[11] 4,087,338

[45] May 2, 1978

[54] ELECTROWINNING OF NICKEL IN DIAPHRAGM-FREE CELLS

[75] Inventors: Aubrey Stewart Gendron, Walden; John Ambrose, Oakville; Victor Alexander Ettel, Mississauga, all of Canada

[73] Assignee: The International Nickel Company, Inc., New York, N.Y.

[21] Appl. No.: 770,472

[22] Filed: Feb. 22, 1977

[30] Foreign Application Priority Data

May 27, 1976 Canada ..... 253463

[51] Int. Cl.[2] ..... C25C 1/08

[52] U.S. Cl. ..... 204/112

[58] Field of Search ..... 204/112, 49, 113

[56] References Cited

U.S. PATENT DOCUMENTS

| | | | |
|---|---|---|---|
| 1,754,125 | 4/1930 | Smith | 204/112 |
| 3,743,585 | 7/1973 | Lowenhaupt | 204/112 |
| 3,928,153 | 12/1975 | Gendron et al. | 204/112 |

FOREIGN PATENT DOCUMENTS

| | | | |
|---|---|---|---|
| 895,500 | 3/1972 | Canada. | |
| 15,524 | 8/1964 | Japan | 204/112 |
| 18,205 | 9/1967 | Japan | 204/112 |

OTHER PUBLICATIONS

Plating and Surface Finishing, vol. 62, pp. 865–869, 1975.

Proceedings of the 14th Electrochemical Seminar, pp. 16–28, 1973.

*Primary Examiner*—T. M. Tufariello

*Attorney, Agent, or Firm*—Lewis Messulam; Ewan C. MacQueen

[57] ABSTRACT

An electrolyte containing an organic buffering agent is used to electrowin nickel with a comparatively high bite in a diaphragm-free cell.

4 Claims, 3 Drawing Figures

ELECTROWINNING OF NICKEL IN DIAPHRAGM-FREE CELLS

The present invention relates to the process of electrowinning nickel in a diaphragm-free cell.

Nickel is conventionally electrowon in cells wherein the cathode is isolated from the anode by a cathode box, or bag comprising a porous diaphragm which surrounds the cathode. While using such cells incorporating a diaphragm enables a relatively large nickel bite, i.e. depletion of nickel in the electrolyte on passage through the cell, to be obtained with good current efficiency, it suffers from several disadvantages. Thus the diaphragms add not only to the cost but also to the bulkiness of the cells; they necessitate the use of separate electrolyte feed-lines to each cathode, and careful handling of the cathodes to avoid tearing of the diaphragms; and by necessitating relatively low current densities they limit the speed at which electrowinning can be performed.

Some of the above-mentioned disadvantages can be obviated by the mere elimination of the cathode box or bag, however, it has generally been found that elimination of the diaphragm results in undesirable reductions in both the nickel bite and current efficiencies obtained. Thus for example in Canadian Pat. No. 958,371 assigned to the SEC Corporation of New Mexico, U.S.A., an example is described of nickel electrowinning from a sulfate electrolyte in a diaphragm-free cell wherein a nickel bite of about 1.5 grams per liter (gpl) is achieved. This can be contrasted with prior art processes involving the use of cathode boxes wherein nickel bites of the order of 15 or even 30 gpl have been achieved.

A proposed process for achieving improved nickel bites in a diaphragm-free nickel electrowinning cell is described in copending Canadian Application No. 197,211, filed Apr. 9, 1974 and assigned in common with the present application. However an essential feature of that process is the need to maintain cell temperatures in excess of 60° C, preferably 70° to 90° C.

It is an object of the present invention to provide a process for electrowinning nickel in a diaphragm-free cell and achieving a reasonably high nickel bite of greater than about 5 gpl without resorting to high operating temperatures, e.g., by operating at 60° C or below.

Generally speaking, the present invention provides a process for electrowinning nickel from a chloride-free nickel-containing electrolyte in a diaphragm-free cell, wherein the electrolyte comprises an aqueous sulfate solution which contains at least about 20 gpl of a buffering agent selected from organic acids and their salts which do not precipitate nickel out of the electrolyte, are resistant to oxidizing conditions in the cell and have a dissociation pK of about 2–5 at 25° C, and wherein the electrowinning is carried out at a temperature of about 40°–60° C, the pH of the electrolyte within the cell being maintained at about 2.5–4.5 while the relative flow rates of electrolyte into and out of the cell are selected to maintain a substantially constant volume of electrolyte within the cell and to cause the nickel concentration in the electrolyte to be depleted by at least about 5 gpl on passage through the cell.

An essential ingredient in the electrolyte used in the process of the invention is an effective buffering agent. The latter needs to possess not only adequate buffering ability, but also adequate buffering capacity, so that if a sufficient amount of the agent is present in the electrolyte, the pH of the latter can be maintained in the desired range of 2.5–4.5 despite the formation of substantial quantities, e.g., 15 gpl or more, of acid during the electrowinning operation. Thus bisulfate ions do not serve as an effective buffering agent due to their inability to buffer at pH values in excess of 2. On the other hand, boric acid, though it may be present in the electrolyte, will not serve as an effective buffering agent because it lacks the buffering capability at pH values lower than 5 and moreover lacks the buffering capacity to cope with substantial amounts of acid formed.

Organic acids such as acetic, propionic, butyric, succinic and citric acids as well as various salts of these acids are particularly useful as buffering agents in the process of the invention. Other considerations which may influence the choice or preference of buffering agent include, for example, the vapor pressure which will be exerted by the agent in question at the cell temperature. To provide the buffering capacity needed when large nickel bites are to be achieved, the buffering agent used must be present in an amount of at least 20 gpl, and preferably at least 50 gpl.

In practising the process of the invention, the electrolyte composition and its flow rates into and out of the cell, the current density used as well as the temperature at which the cell is maintained are correlated to achieve the desired nickel bite. Thus in a specific embodiment of the invention electrolyte having a pH of about 5–6 measured at room temperature is treated in a diaphragm-free cell maintained at 55° C. By selecting the flow rate it is possible to achieve nickel bites of 10 gpl or more with good current efficiency. The latter decreases generally with increasing nickel bite, but can be of the order of 75% or more when the nickel bite is of the order of 10 gpl.

According to a preferred feature of the invention, the cell is operated at 50°–55° C and the pH in the cell measured at operating temperature, is maintained within the range of 3–4. The pregnant electrolyte introduced into the cell, preferably has a pH of about 5–6 measured at room temperature and contains about 40–130 gpl of nickel. The electrolyte may also include reagents which improve the conductivity thereof, or the appearance of the deposited nickel. Thus advantageously sodium sulfate in an amount up to 75 gpl, and magnesium sulfate in an amount of 0.5 gpl or more may be present in the electrolyte.

The process of the invention can be practised by using a wide range of current densities, e.g., as low as 50 or as high as 1500 amperes per square meter of cathode; it is generally preferred to employ a current density of 300–1000 amperes per square meter of cathode. Because of the elimination of cathode boxes, the cells used in the process of the invention are relatively compact with anode to cathode spacings of the order of 2.5–5 centimeters. As a result of using such small spacings, the power requirements are considerably reduced and are comparable to those prevailing in conventional cells using much lower current densities.

The electrodes used in practising the process of the invention may be any of the wide variety of known electrodes for nickel electrowinning. Thus, for example, the anode may comprise a titanium sheet coated with a noble metal, while the cathode may comprise a nickel starter sheet, or a sheet of stainless steel or titanium suitably treated to give the desired degree of adhesion to the deposit.

Specific examples of the invention will now be described.

DETAILED DESCRIPTION

Example 1

Figure 1:
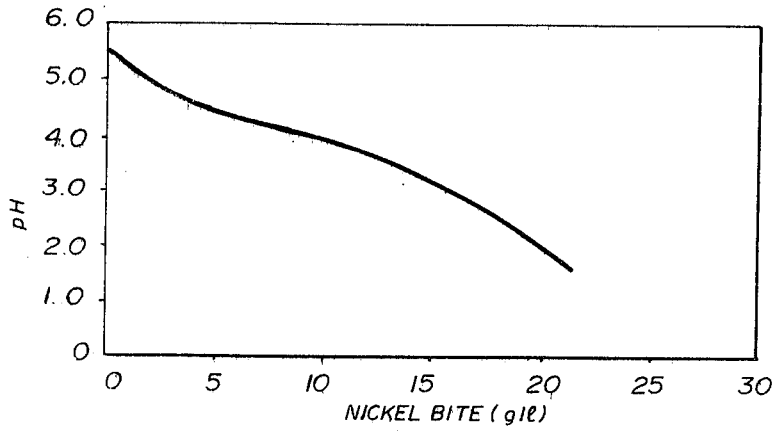
FIG. 1 shows the variation of nickel bite obtained with the operating pH maintained in the cell, as measured at the cell temperature, in the tests of Example 1 below.
Figure 2:
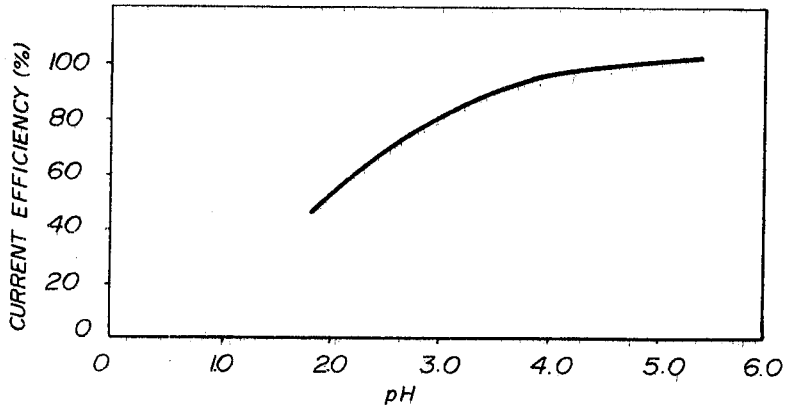
FIG. 2 shows the current efficiency, calculated from the cell voltage and current and the weight of deposited nickel, as a function of the operating pH in the tests of Example 1.
Figure 3:
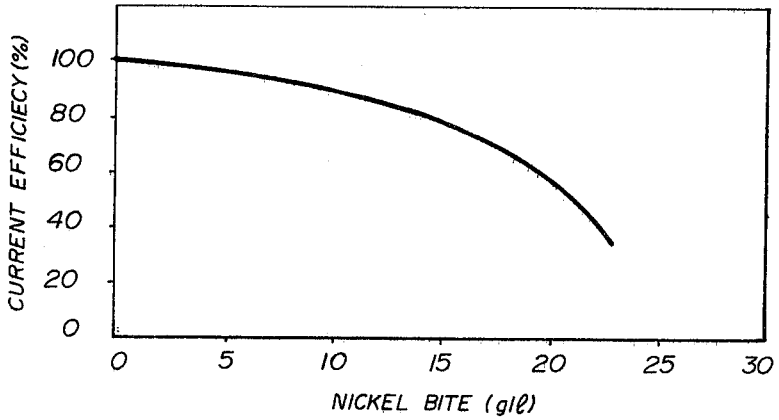
FIG. 3 represents the same data in form of a plot of the current efficiency as a function of the nickel bite.

A series of electrowinning tests were performed using an electrolyte comprising 85 gpl of nickel as nickel sulfate, 75 gpl of sodium acetate ($CH_3COONa.3H_2O$), 75 gpl of sodium sulfate and 5 gpl of magnesium sulfate. A diaphragm-free cell was used in which the anode consisted of a commercial dimensionally stabilized anode sheet having a surface area of 0.64 square decimeters, and the cathode consisted of a nickel starter sheet having a surface area of 1 $dm^2$ and spaced from the anode by 2.5 cm. The electrolyte was introduced into the cell at a pH, measured at room temperature, of 5.5. The electrolyte within the cell was maintained at 55±2° C while electrowinning was carried out with the current density controlled at 500 amp/$m^2$. The tests were performed for deposition periods ranging from 30 seconds to 40 minutes, and the results obtained are illustrated in the graphs of FIGS. 1-3 of the accompany drawings.

It will be seen from the drawings that by controlling the electrowinning operation to maintain a cell pH within the range of 2.5 to 4.5 nickel bites of up to about 15 gpl were achieved. The current efficiency, though somewhat lower at such high nickel bites, was nevertheless of the order of 80% or more. In all cases the nickel deposits were found to be smooth, pit-free and bright.

Example 2

In this example, the electrolyte used was of the same composition as in Example 1. The cell used in this case differed in that the cathode was a sandblasted titanium sheet with a surface area of 0.32 $dm^2$. The test was performed, at 55±2° C, with a 1000 amp/$m^2$ cathodic current density (the cell voltage being 2.78 volts) for a 24 hour duration. The flow rates of electrolyte into and out of the cell were selected to maintain an operating pH of about 3.5 and obtain a nickel bite of 10 gpl. The calculated current efficiency was 83%. During the 24 hour test no visual evidence of decomposition of the organic buffering agent at the anode was detected.

Example 3

Using the same solution and cell as in Example 2, a test was performed using a lower cell voltage (2.6 volts) to maintain a cathodic current density of 650 amp/$m^2$. The flow rates in this case were controlled to maintain an operating pH of about 3 at 55±2° C. The resulting nickel bite and current efficiency were found to be 13.5 gpl and 75% respectively.

Example 4

An electrolyte containing: 85 gpl of nickel (as nickel sulfate), 80.5 gpl of sodium propionate, 75 gpl of sodium sulfate and 5 gpl of magnesium sulfate, was used in the same cell as that of Examples 2 and 3. The pregnant electrolyte was fed into the cell at a room temperature pH of about 6. The cell voltage of 2.5 volts was selected to give a cathodic current density of 300 amp/$m^2$, and the flow rates were controlled to maintain a pH of about 4 in the cell, as measured at the operating temperature (55±2° C). The resulting nickel deposit was found, as in the previous examples, to be bright and pit free, and the nickel bite and current efficiency were found to be 10 gpl and 80%, respectively.

The above examples show the efficacy of incorporating in the electrolyte salts of acetic acid (which has a pK of 4.8 at 25° C) and propionic acid (pK = 4.9 at 25° C). Citric acid, which has a first dissociation with a pK of about 3 at room temperature, has also been found to be an effective buffer for enabling high nickel bites to be obtained in the process. By way of contrast it may be stated that performing tests similar to those described in the examples but using electrolytes which did not contain the organic buffering agents resulted in nickel bites of less than 3 gpl and current efficiencies of the order of 40-60% at the cell temperatures in question, i.e. below 60° C.

While the invention has been described with reference to preferred embodiments thereof, it will be understood that various modifications may be resorted to without departing from the scope of the invention which is defined by the appended claims.

We claim:

1. A process for electrowinning nickel from a chloride-free nickel-containing electrolyte in a diaphragm-free cell, wherein the electrolyte comprises an aqueous sulfate solution which contains at least about 20 grams per liter of a buffering agent selected from organic acids and their salts which do not precipitate nickel out of the electrolyte, are resistant to oxidizing conditions in the cell and have a dissociation pK of about 2-5 at 25° C, and wherein the electrowinning is carried out at a temperature of about 40°-60° C, the pH of the electrolyte within the cell being maintained at about 3 to 4 while the relative flow rates of electrolyte into and out of the cell are selected to maintain a substantially constant volume of electrolyte within the cell and to cause the nickel concentration in the electrolyte to be depleted by at least about 10 grams per liter on passage through the cell.

2. A process in accordance with claim 1 wherein the buffering agent is selected from the group consisting of acetic acid, propionic acid, citric acid and salts thereof.

3. A process in accordance with claim 1 wherein the electrolyte comprises about 40-130 grams per liter of nickel, at least about 0.5 grams per liter of magnesium sulfate, up to about 75 grams per liter of sodium sulfate and at least about 50 grams per liter of the buffering agent.

4. A process in accordance with claim 3 wherein the electrowinning is carried out at a temperature of about 50°-55° C and a cathodic current density of about 300-1000 amperes per square meter.

* * * * *